US006099451A

United States Patent [19]

Mulder et al.

[11] Patent Number: 6,099,451

[45] Date of Patent: Aug. 8, 2000

[54] METHOD AND APPARATUS FOR MANUFACTURING A BAG WITH A RECLOSABLE ZIPPER

[75] Inventors: Steven C. Mulder, Benton Harbor; James K. Holmes, Niles, both of Mich.

[73] Assignee: Robert Bosch Corporation, Broadview, Ill.

[21] Appl. No.: 09/241,564

[22] Filed: Feb. 1, 1999

Related U.S. Application Data

[60] Provisional application No. 60/073,343, Feb. 2, 1998.

[51] Int. Cl.[7] ..... B31B 1/90

[52] U.S. Cl. ..... 493/214; 493/213; 53/139.2

[58] Field of Search ..... 493/213, 214, 493/927, 940; 53/451, 452, 133.4, 412, 139.2

[56] References Cited

U.S. PATENT DOCUMENTS

| | | |
|---|---|---|
| 4,617,683 | 10/1986 | Christoff . |
| 4,709,398 | 11/1987 | Ausnit . |
| 4,878,987 | 11/1989 | Ven Erden . |
| 4,894,975 | 1/1990 | Ausnit . |
| 4,909,017 | 3/1990 | McMahon et al. . |
| 5,529,659 | 6/1996 | Ellsworth et al. . |
| 5,573,614 | 11/1996 | Tilman et al. . |
| 5,592,802 | 1/1997 | Malin et al. . |
| 5,672,234 | 9/1997 | Rodenstein et al. . |
| 5,816,018 | 10/1998 | Bois . |
| 5,823,933 | 10/1998 | Yeager . |
| 5,951,453 | 9/1999 | Yeager ..... 493/214 |

FOREIGN PATENT DOCUMENTS

| | | |
|---|---|---|
| 0410126 | 1/1991 | European Pat. Off. . |

*Primary Examiner*—John Sipos
*Assistant Examiner*—Steven Jensen
*Attorney, Agent, or Firm*—Michael Best & Friedrich LLP

[57] ABSTRACT

An apparatus and method for manufacturing a bag with a reclosable zipper includes feeding an elongated sheet of bag film in a first direction under a placement head. A zipper assembly is fed in a second direction substantially perpendicular to the first direction into the placement head, and the segment of the zipper assembly in the placement head is cut off. Rollers may be used to retain the zipper segment in the placement head. The placement head, with the zipper segment, is moved adjacent the bag film. The bag film is then compressed between a hot sealing bar and a resilient portion of the placement head to seal the zipper segment to the bag film. Then the bag film is folded over the zipper segment, sealed along a bottom and rear seam, and sealed to the other side of the zipper segment.

21 Claims, 6 Drawing Sheets

METHOD AND APPARATUS FOR MANUFACTURING A BAG WITH A RECLOSABLE ZIPPER

This application claims the benefit of U.S. Provisional Application No. 60/073,343, filed Feb. 2, 1998.

BACKGROUND

The invention relates to a method and apparatus for manufacturing a bag with a reclosable zipper.

SUMMARY OF THE INVENTION

The invention provides a method and apparatus in which an elongated web of bag film is fed under an in-line zipper applicator which includes a placement head.

More particularly, the invention provides a method of manufacturing a bag with a reclosable zipper, the method comprising the steps of:

(a) providing an elongated web of bag film having a longitudinal axis and a width in a direction perpendicular to the axis;

(b) providing a zipper segment including male and female strips of zipper engaged so that the zipper segment is in a closed condition, the zipper segment having a length approximately one-half the width of the web;

(c) providing a zipper placement head;

(d) inserting the zipper segment into the placement head so that the zipper segment extends generally perpendicular to the axis and so that the zipper segment extends only partially across the web;

(e) moving the placement head and zipper segment generally perpendicular to and toward the web;

(f) sealing one of the male and female strips of the zipper segment to the web;

(g) removing the zipper segment from the placement head; and (h) folding the web over the other of the male and female strips of the zipper segment and sealing the web thereto so as to form a bag with the zipper in the mouth of the bag.

Preferably, once a desired length of web has passed beneath the placement head, the web feed is stopped, and a zipper segment is placed on the web by the placement head so that the zipper segment extends perpendicular to the longitudinal axis of the web. The zipper placement head cooperates with a seal bar to seal the zipper segment to the web. After the zipper segment is sealed to the web, more web is fed under the placement head to receive the next zipper segment, and the attached zipper segment is carried away with the moving web.

The invention also provides an apparatus for manufacturing a bag with a reclosable zipper from a continuous web of bag film and from a continuous length of zipper assembly having male and female strips of zipper engaged so that the zipper is in a closed condition, the apparatus comprising a placement head adapted to support a segment of the zipper assembly, the placement head including a support strip adapted to extend between the male and female strips of the zipper segment, and the placement head including at least one roller adapted to hold the zipper segment against the support strip, the roller being oriented such that rotation of the roller in response to insertion of the zipper segment into the placement head maintains the zipper segment against the support strip.

The invention also provides an apparatus for manufacturing a bag with a reclosable zipper, the apparatus utilizing an elongated web of bag film having a longitudinal axis and a width in a direction perpendicular to the axis, the apparatus comprising:

placing means for placing on the web a zipper segment, the zipper segment including male and female strips of zipper engaged so that the zipper segment is in a closed condition, the zipper segment being placed on the web so that the zipper segment extends perpendicular to the axis, and the zipper segment having a length approximately one-half the width of the web so that the zipper segment extends only partially across the web, the placing means including means for moving a length of zipper over the web in a direction perpendicular to the axis, and means for cutting the length of zipper to provide the zipper segment, the placing means further including a zipper placement head and means for moving the length of zipper into the zipper placement head prior to cutting the length of zipper, so that the zipper segment is located in the zipper placement head, and means for moving the zipper placement head toward and generally perpendicular to the web so as to place the zipper segment on the web;

sealing means for sealing one of the male and female strips of the zipper segment to the web; and folding and sealing means for folding the web over the other of the male and female strips of the zipper segment and sealing the web thereto so as to form a bag with the zipper in the mouth of the bag.

Other features and advantages of the invention will become apparent to those skilled in the art upon review of the following detailed description, claims, and drawings.

Figure 1:
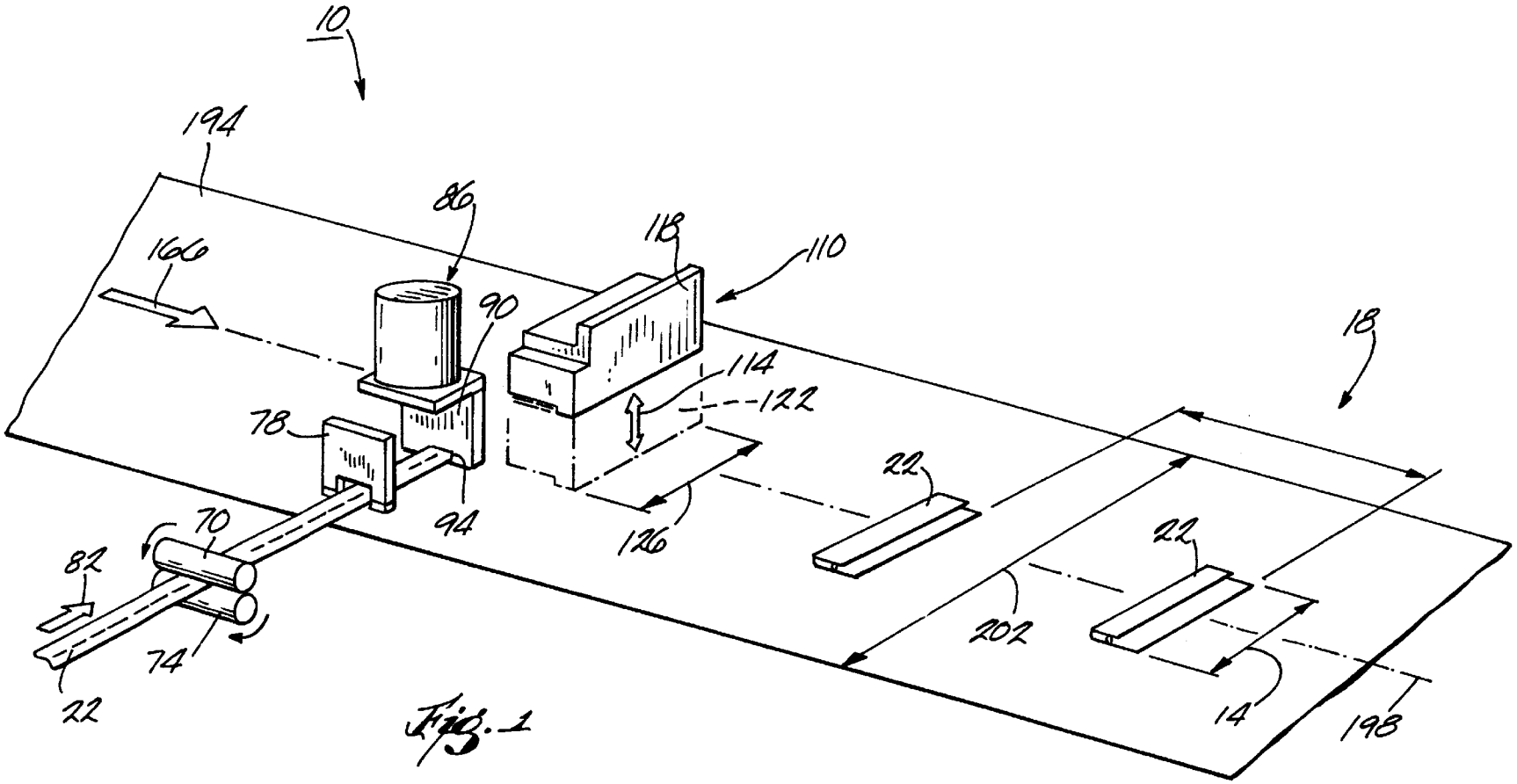
FIG. 1 is a perspective view of an in-line zipper applicator embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method is not meant to indicate that the steps should be performed in a particular order.

DETAILED DESCRIPTION

FIG. 1 illustrates an apparatus 10 for manufacturing plastic bags with reclosable zippers. Each bag (not shown) has a width 14, a length 18, and a mouth with a resealable zipper.

Figure 2:
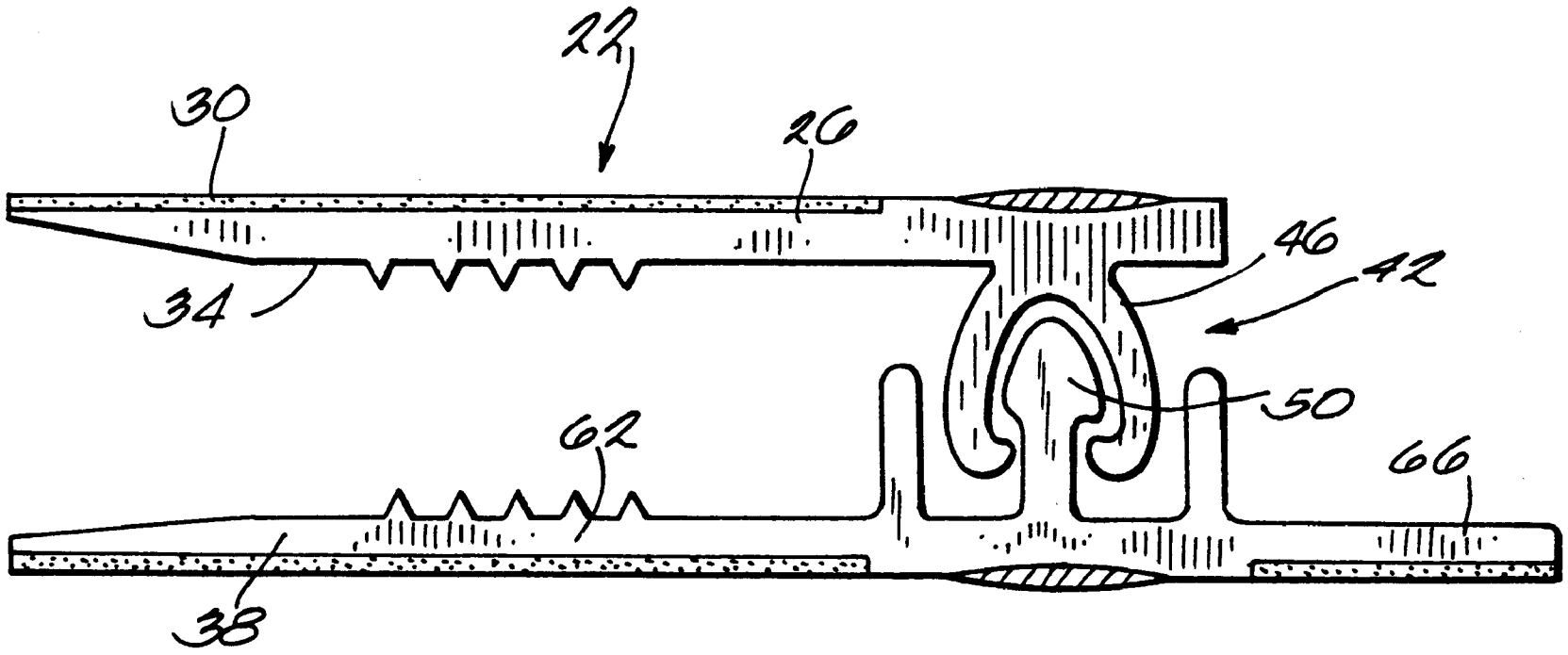
FIG. 2 is an enlarged cross-sectional view of the encircled portion labeled A in FIG. 1.
Figure 3:
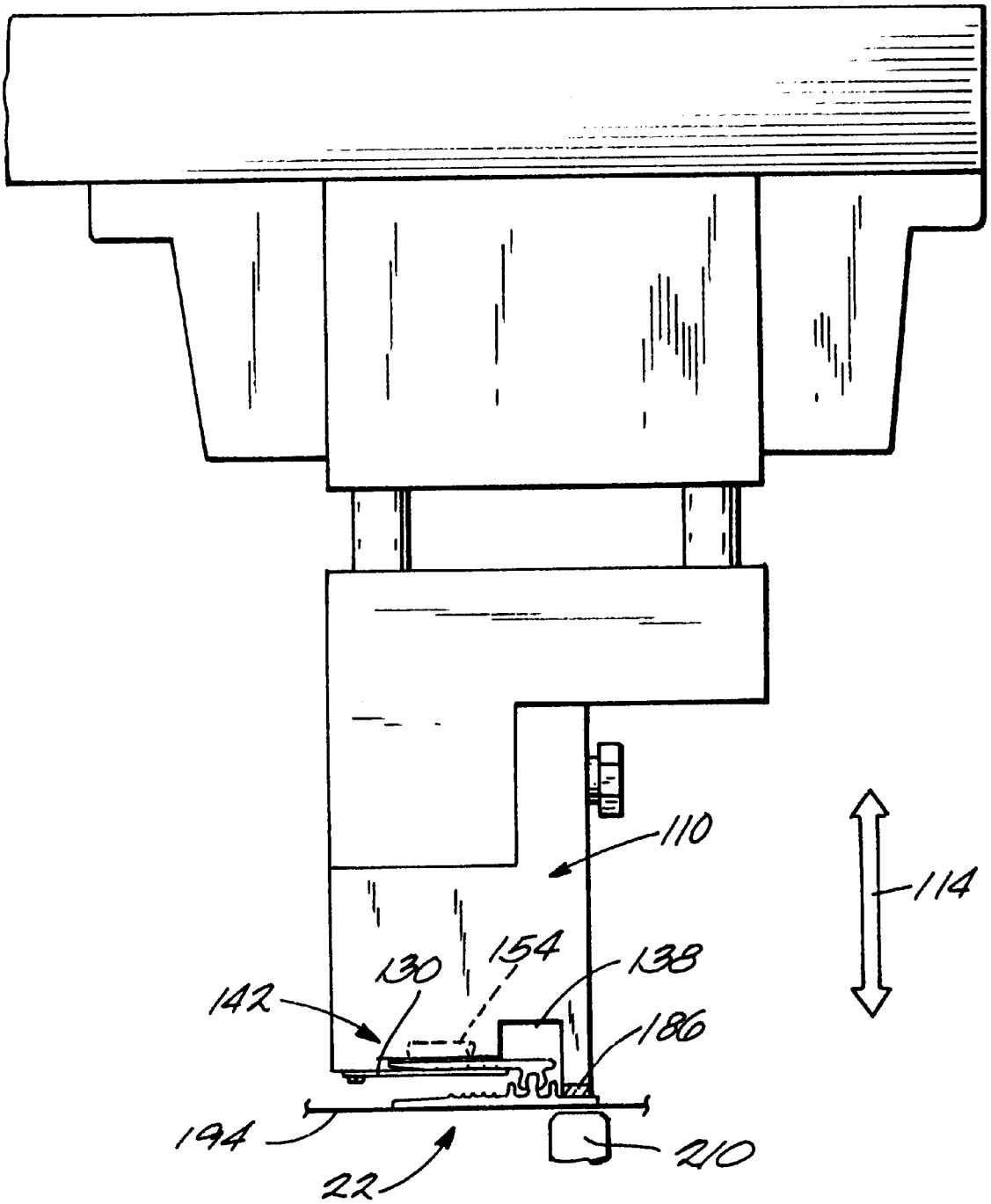
FIG. 3 is an enlarged side elevational view of the zipper placement head shown in FIG. 1.

FIG. 2 illustrates a zipper assembly 22 that is fed into the apparatus 10. The zipper assembly 22, which is shown in the closed condition, includes a first flange or female strip 26 having a top surface 30 and a bottom surface 34, a second flange or male strip 38, and a zipper 42 between the first and second flanges 26, 38. The zipper 42 includes a female portion 46 attached to or formed integrally with the first flange 26, and a male portion 50 attached to or formed integrally with the second flange 38. The entire zipper assembly 22 is preferably made of extruded plastic.

The second flange 38 includes first and second portions 62, 66. The first portion 62 of the second flange 38 is positioned opposite the first flange 26, and is substantially the same size as the first flange 26.

Figure 7:
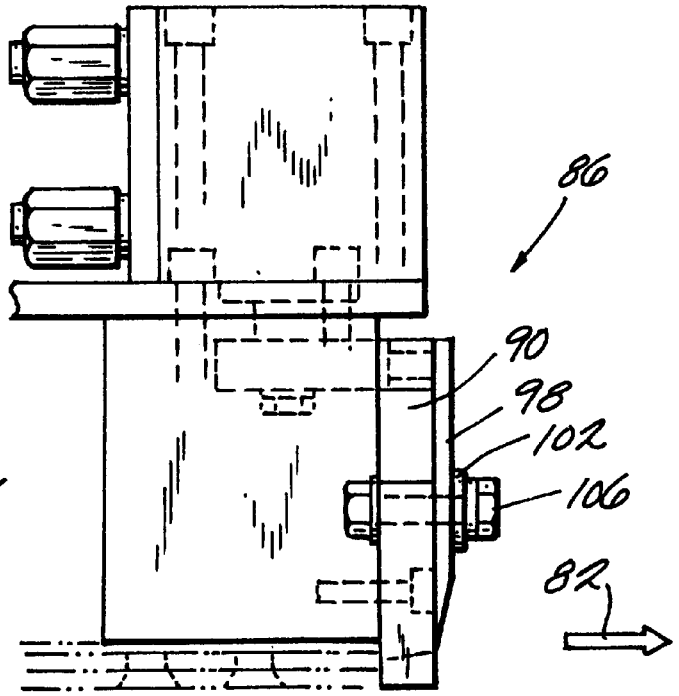
FIG. 7 is a side view of the zipper knife shown in FIG. 1.

As shown in FIG. 1, the zipper assembly 22 is acted upon by a servo driven roller 70 and a tension roller 74, which feed the zipper assembly 22 through a guide and track 78. In this manner, the zipper assembly 22 travels in a first direction 82 through a zipper knife assembly 86, shown in FIGS. 1 and 7. The zipper knife assembly 86 includes a shear plate 90 having a profiled slot 94 through which the zipper assembly 22 passes. The zipper knife assembly 86 also includes a zipper knife 98 that is held against the shear plate 90 by a disc spring 102 and fastener 106.

As the zipper assembly 22 passes through the profiled slot 94 in the shear plate 90, it enters a zipper placement head 110. The zipper placement head 110 is movable along a vertical line 114 as shown in FIG. 1 between an "up" position 118 (shown in solid lines) and a "down" position 122 (shown in broken lines). The zipper placement head 110 is in the up position when it receives the zipper assembly 22. The zipper placement head 110, best seen in FIGS. 3–6, has a width 126 that is substantially equal to the width 14 of the plastic bag produced by the manufacturing system 10.

Figure 4:
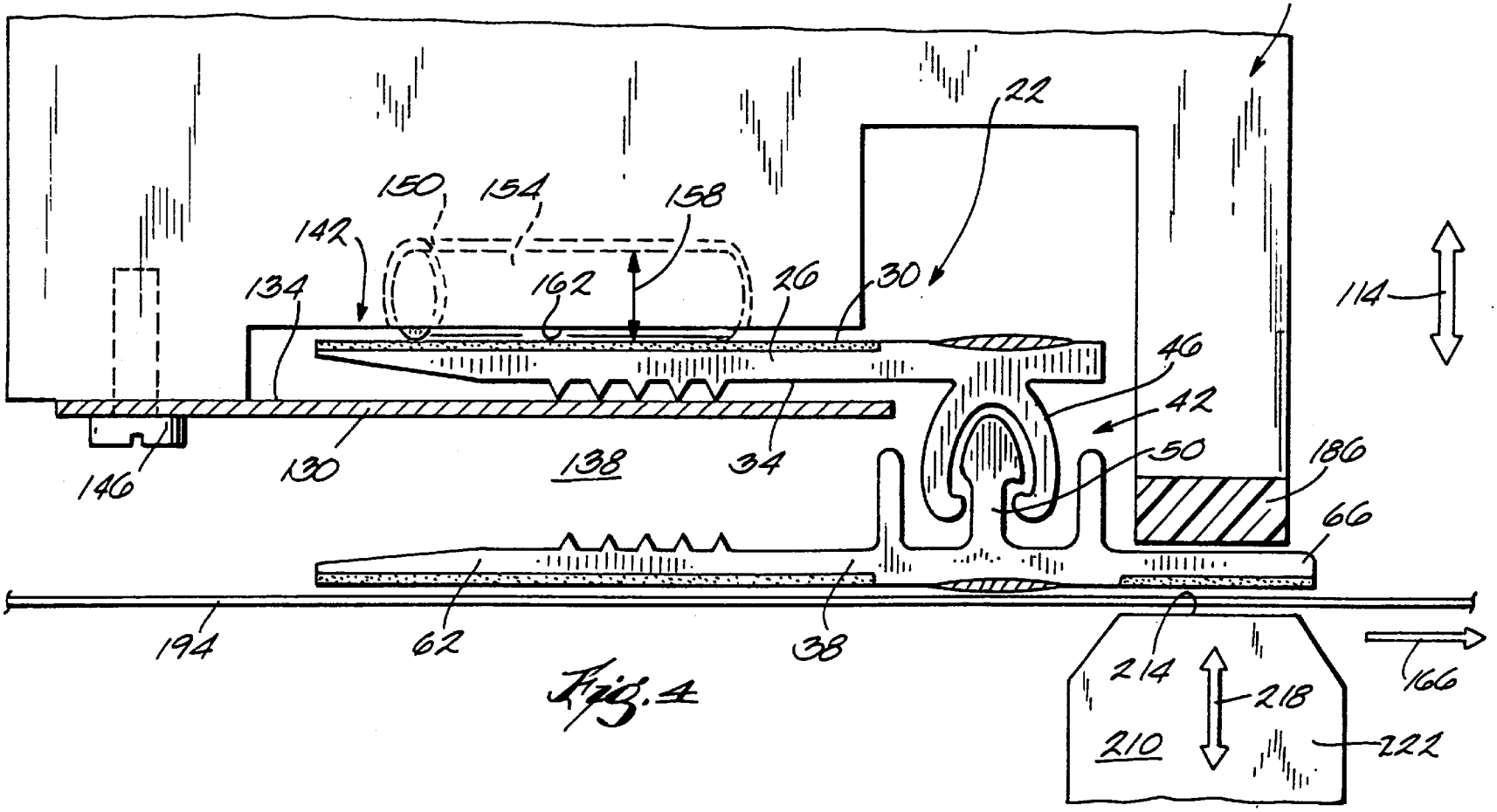
FIG. 4 is an enlarged view of the encircled portion labeled B in FIG. 3.
Figure 5:
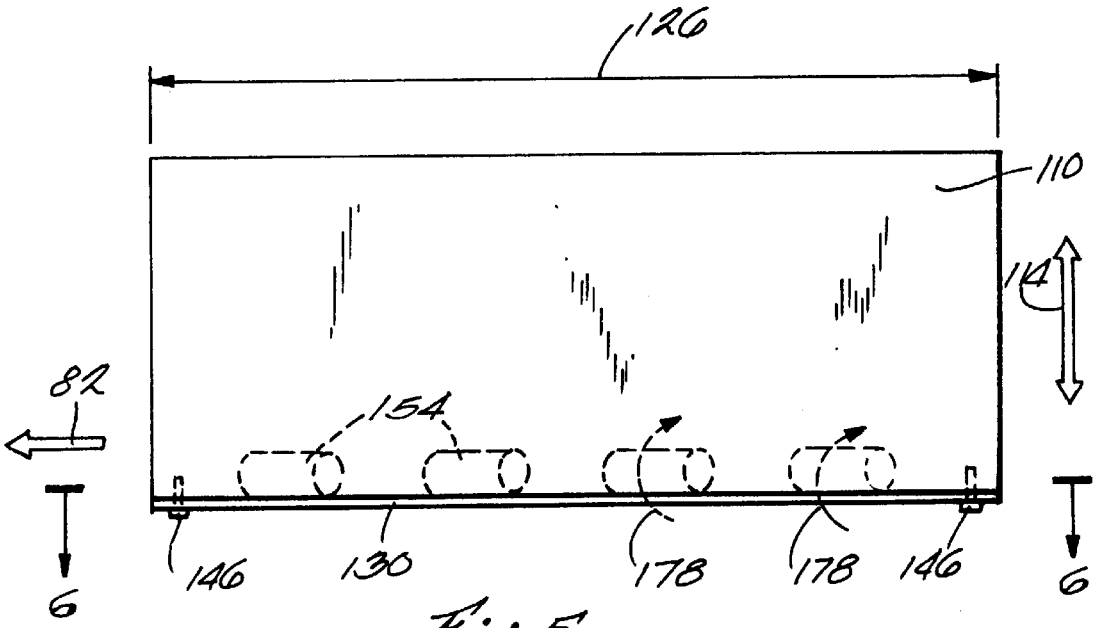
FIG. 5 is a front elevational view of the zipper placement head shown in FIG. 3.
Figure 6:
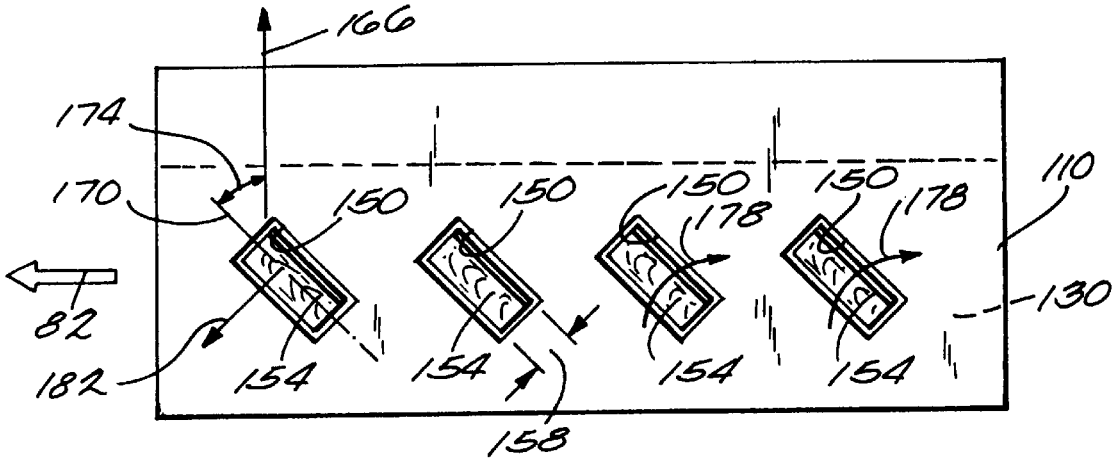
FIG. 6 is a sectional view taken along line 6—6 in FIG. 5.

As seen in FIGS. 4–6, the placement head 110 includes a support strip 130 having a top surface 134. The support strip 130 is positioned along the entire width 126 of the placement head 110. The support strip 130 is preferably made of stainless steel. The placement head 110 also includes a cavity 138 along a bottom portion 142 of the placement head 110. The support strip 130 is attached to the placement head 110 by a plurality of screws 146, and extends horizontally into the cavity 138.

Above the support strip 130 is a series of recesses 150, each recess 150 housing a dowel pin or roller 154. Each dowel pin 154 has a diameter 158. Each dowel pin 154 is free-floating in its corresponding recess 150, such that the dowel pin 154 projects out of an open end 162 of the recess 150 and rests on the top surface 134 of the support strip 130. The dowel pin 154 projects from the recess 150 a distance less than half the diameter 158 of the dowel pin 154, and preferably as little as practical, to ensure that the dowel pin 154 will not come entirely out of the recess 150 unless the support strip 130 is removed from the placement head 110. The recesses 150 are oriented with respect to a second direction 166 (the direction of movement of the bag film, as explained below) such that the axis of rotation 170 of each dowel pin 154 is oriented at an angle 174 with respect to the second direction 166 as shown in FIG. 6. The second direction 166 is substantially perpendicular to the first direction 82.

When the zipper assembly 22 passes through the profiled slot 94 and into the zipper placement head 110, the bottom surface 34 of the first flange 26 slides along the top surface 134 of the support strip 130, and the top surface 30 of the first flange 26 moves beneath the dowel pins 154. The dowel pins 154, therefore, rest on the top surface 30 of the first flange 26.

The weight of the dowel pins 154 helps to hold the first flange 26 against the support strip 130. Also, frictional forces between the top surface 30 of the first flange 26 and the dowel pins 154 cause the dowel pins 154 to rotate in a clockwise direction 178 as seen in FIG. 5. Because of the angle 174 of the axes 170 of the dowel pins 154, and because of the friction between the dowel pins 154 and the top surface 30 of the first flange 26, the dowel pins 154 also tend to urge the zipper assembly 22 in a direction 182 (FIG. 6) perpendicular to the axes of rotation 170 as the dowel pins 154 rotate, thereby ensuring that the zipper assembly 22 is held in the zipper placement head 110.

Referring to FIG. 4, the placement head 110 also includes a resilient strip 186 attached along the width of the placement head 110. The resilient strip 186 is preferably a silicone rubber strip. When the zipper assembly 22 is fed into the placement head 110 as described above, the second portion 66 of the second flange 38 is positioned below the resilient strip 186.

When a desired length of zipper assembly 22 has been feed through the profiled slot 94 in the shear plate 90, the rollers 70, 74 stop rotating, and the knife 98 operates on the zipper assembly 22. When the placement head 110 is in the up position 118, it is positioned in close proximity to the shear plate 90. Again referring to FIG. 7, the spring action of the spring 102 holds the knife 98 against the shear plate 90, and thereby creates a shearing force on the zipper assembly 22 and severs the zipper assembly 22. In this manner, a zipper segment of a length substantially equal to the width 126 of the placement head 110 is created, and the zipper segment is held in the cavity 138 of the placement head 110.

As seen in FIG. 1, a web of plastic bag film 194 having a longitudinal axis 198 and a width 202 is fed in the second direction 166 along the longitudinal axis 198 by a drive mechanism (not shown). The length of the zipper segment and the width 126 of the placement head 110 are both approximately one half the width 202 of the web 194. The placement head 110 is substantially centered over the width 202 of the web 194. The width 202 of the plastic web 194 is substantially twice the width 14 of the plastic bag.

After a desired length of web 194, equal to approximately the length 18 of the plastic bag, travels beneath the zipper placement head 110, the drive mechanism stops feeding the web 194, and the web 194 comes to a stop. Then the placement head 110 is moved to the down position 122, where it is in close proximity to the web 194.

As best seen in FIG. 4, a cylinder or seal bar 210 is positioned beneath the web 194, and extends a length (not shown) substantially equal to the width 126 of the placement head 110. The cylinder 210 has a hot surface 214. The cylinder 210 is aligned with the resilient strip 186 of the placement head 110, and is movable along a vertical line 218 between an engaging position (not shown) wherein the cylinder 210 compresses a portion of the web 194 against the resilient strip 186, and a disengaging position 222 (shown in FIG. 4), wherein the cylinder 210 allows the web 194 to pass between the cylinder 210 and the placement head 110. While in the engaging position, the hot surface 214 heats the web 194 and second portion 66 of the second flange 38, and the cylinder 210 presses the web 194 and second portion 66 against the resilient strip 186, thereby causing the web 194 to fuse to the second portion 66 of the second flange 38. In this manner, the zipper segment is attached to the web 194 perpendicular to the web longitudinal axis 198.

We have found that a resilient strip works best for ensuring a reliable seal along the entire length of the zipper segment between the web 194 and the second portion 66 of the second flange 38. It is also possible to obtain a good seal between the web 194 and the zipper segment using a non-resilient strip of metal or other hard substance, but such a seal cannot be obtained as reliably and consistently as when a resilient strip is used.

After the web 194 has been fused to the second flange 38 of the zipper segment, the placement head 110 is raised to the up position 118, and the web 194 is advanced in the second direction 166 by the drive mechanism. As the placement head 110 is raised and the web 194 advanced, the zipper segment is pulled off the support strip 130 and under the resilient strip 186, and is carried away by the web 194.

The process described above then repeats, with another length of zipper assembly 22 being fed into the placement head 110 and cut with the knife 98 to create a zipper segment held in the cavity 138 of the placement head 110. The web 194 is again advanced in the second direction 166 a distance equal to the length 18 of the plastic bag, and the placement head 110 is lowered to a position 122 closely proximate to the web 194. The cylinder 210 is again raised to the engaging position where heat and pressure are applied to the web 194, thereby fusing the zipper segment to the web 194. The placement head 110 again raises and the web 194 again carries the zipper segment away.

Figure 8:
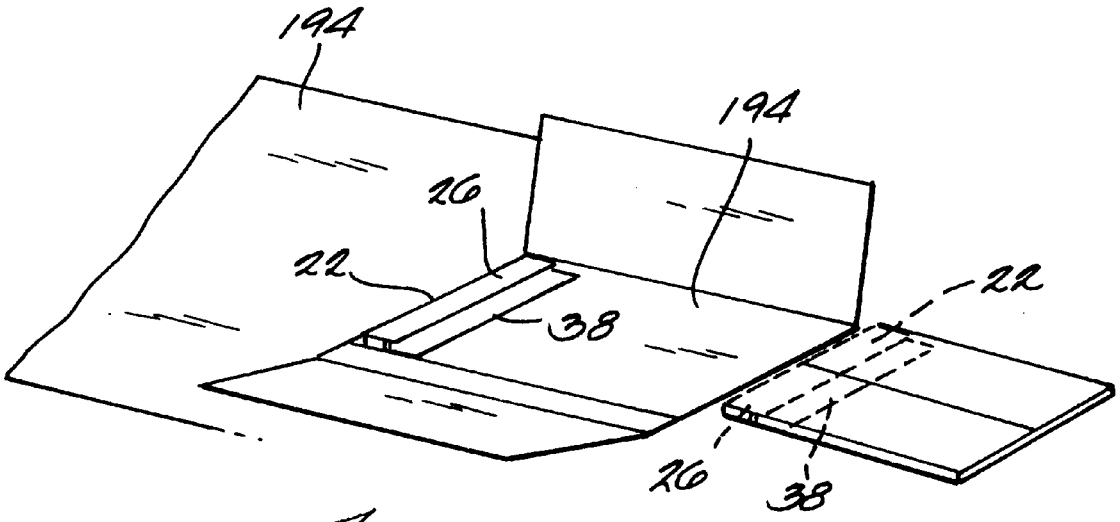
FIG. 8 illustrates the bag film being folded over a zipper segment to form a bag.

After the zipper segment is attached to the web 194, the web 194 is moved by the drive mechanism to a conventional vertical form, fill, and seal machine (not shown), where the web 194 is folded over the zipper segment (partially shown in FIG. 8) and sealed to the first flange 26 to form the bag, which is then filled with product and the top of the bag sealed for shipping.

The above description should not be regarded as limiting with respect to the orientation of the male and female portions 50, 46 of the zipper 42. The above-described method for attaching the zipper assembly 22 to the web 194 will work equally well if the male portion 50 of the zipper 42 is attached to the first flange 26, thereby making the first flange 26 the male flange, and the female portion 46 of the zipper 42 attached to the second flange 38, making the second flange 38 the female flange.

What is claimed is:

1. A method of manufacturing a bag with a reclosable zipper, the method comprising the steps of:

(a) providing an elongated web of bag film having a longitudinal axis and a width in a direction perpendicular to the axis;

(b) providing a zipper segment including male and female strips of zipper engaged so that the zipper segment is in a closed condition, the zipper segment having a length approximately one-half the width of the web, one of the male and female strips including a flange;

(c) providing a zipper placement head having a support strip;

(d) inserting the zipper segment into the placement head, and supporting the zipper segment flange with said support strip so that the zipper segment extends generally perpendicular to the axis and so that the zipper segment extends only partially across the web;

(e) moving the placement head and zipper segment generally perpendicular to and toward the web;

(f) sealing one of the male and female strips of the zipper segment to the web;

(g) removing the zipper segment from the placement head; and (h) folding the web over the other of the male and female strips of the zipper segment and sealing the web thereto so as to form a bag with the zipper in the mouth of the bag.

2. The method of claim 1, wherein step (a) includes providing a continuous feed of an elongated web of bag film in a direction generally parallel to the longitudinal axis; and steps (b) and (d) include providing to the zipper placement head a continuous feed of a zipper assembly in a direction generally perpendicular to the longitudinal axis, and cutting the zipper assembly to provide the zipper segment in the zipper placement head.

3. The method of claim 1, wherein step (g) includes moving the web in a direction parallel to the longitudinal axis.

4. The method of claim 1, wherein step (f) includes sealing the one of the male and female strips of the zipper segment in a position substantially centered with respect to the lateral edges of the web.

5. The method of claim 1, wherein the support strip has a top surface, wherein the placement head has therein, above the support strip, a series of recesses, each recess housing a free-floating roller that rests on the top surface of the support strip when the zipper segment is not in the placement head, such that when the zipper segment moves into the placement head, a portion of the zipper segment slides along the top surface of the support strip, and the top surface of the zipper segment portion moves beneath the rollers, so that frictional forces between the zipper portion and the rollers cause the rollers to rotate and thereby urge the zipper segment in a direction holding the zipper segment in the placement head.

6. The method of claim 5, wherein step (g) includes moving the placement head away from the web and moving the web so that the zipper segment is pulled off the support strip and is carried away by the web.

7. The method of claim 6, wherein the placement head also includes a resilient strip positioned so that, when the zipper segment moves into the placement head, a portion of the zipper segment is positioned below the resilient strip, and wherein step (f) includes compressing a portion of the web against the resilient strip.

8. A method as set forth in claim 7 wherein step (f) further includes the steps of providing a seal bar on the opposite side of the web from the zipper placement head, and pressing the web and the zipper segment between the zipper placement head and the seal bar to seal the zipper segment to the web.

9. The method of claim 1, wherein step (c) includes providing at least one roller positioned at an angle less than 90° and greater than 0° relative to the zipper segment, and wherein step (d) includes inserting the zipper segment into the placement head with the flange between the support strip and the roller, and rotating the roller to maintain the zipper in the placement head.

10. An apparatus for manufacturing a bag with a reclosable zipper from a continuous web of bag film and from a continuous length of zipper assembly having male and female strips of zipper engaged so that the zipper is in a closed condition, the zipper assembly also having a flange, the apparatus comprising a placement head adapted to support a segment of the zipper assembly, the placement head including a support strip adapted to support the zipper segment flange, and the placement head including at least one roller adapted to hold the flange against the support strip, the roller being oriented such that rotation of the roller in response to insertion of the zipper segment into the placement head maintains the flange against the support strip.

11. The apparatus of claim 10, wherein the placement head is movable in a generally perpendicular direction with respect to the web.

12. The apparatus of claim 10, wherein the placement head has therein, above the support strip, a recess housing the roller, the roller resting on the top surface of the support strip when the zipper segment is not in the placement head, such that when the zipper segment moves into the placement head, the flange slides along the top surface of the support strip, and the top surface of the flange moves beneath the roller, causing the roller to rotate.

13. The apparatus of claim 10, wherein the placement head also includes a resilient strip positioned so that, when the zipper segment moves into the placement head, a portion of the zipper segment is positioned below the resilient strip, the resilient strip being cooperable with a sealing bar to seal the portion of the zipper segment to the web with heat and pressure.

14. The apparatus of claim 10, wherein the support strip has a top surface, wherein the placement head has therein, above the support strip, a series of recesses, each recess housing a roller that is free-floating and that rests on the top surface of the support strip when the zipper segment is not in the placement head, such that when the zipper segment moves into the placement head, the flange slides along the top surface of the support strip, and the top surface of the flange moves beneath the rollers, so that frictional forces between the flange and the rollers cause the rollers to rotate and thereby urge the zipper segment in a direction holding the zipper segment in the placement head.

15. The apparatus of claim 10, wherein the roller is positioned at an angle less than 90° and greater than 0° relative to the zipper segment.

16. An apparatus for manufacturing a bag with a reclosable zipper, the apparatus utilizing an elongated web of bag film having a longitudinal axis and a width in a direction perpendicular to the axis, the apparatus comprising:

placing means for placing on the web a zipper segment, the zipper segment including male and female strips of zipper engaged so that the zipper segment is in a closed condition, and including a flange, the zipper segment being placed on the web so that the zipper segment extends perpendicular to the axis, and the zipper segment having a length approximately one-half the width of the web so that the zipper segment extends only partially across the web, the placing means including means for moving a length of zipper over the web in a direction perpendicular to the axis, and means for cutting the length of zipper to provide the zipper segment, the placing means further including a zipper placement head having a support strip that extends beneath the zipper segment flange, and a plurality of floating rollers that hold the flange against the support strip, the placing means further including means for moving the length of zipper into the zipper placement head prior to cutting the length of zipper, so that the zipper segment is located in the zipper placement head, and means for moving the zipper placement head toward and generally perpendicular to the web so as to place the zipper segment on the web;

sealing means for sealing one of the male and female strips of the zipper segment to the web; and folding and sealing means for folding the web over the other of the male and female strips of the zipper segment and sealing the web thereto so as to form a bag with the zipper in the mouth of the bag.

17. An apparatus as set forth in claim 16 and further comprising means for moving the web in the direction of the axis prior to folding the web over the other of the male and female strips.

18. An apparatus as set forth in claim 16 wherein the rollers are at an angle relative to the direction of movement of the length of zipper so as to maintain the zipper in the desired position in the zipper placement head.

19. An apparatus as set forth in claim 16 wherein the sealing means includes a seal bar on the opposite side of the web from the zipper placement head, and means for pressing the web and the zipper segment between the zipper placement head and the seal bar to seal the zipper segment to the web.

20. An apparatus as set forth in claim 19 and further comprising means for moving the web in the direction of the axis after sealing the zipper segment to the web, thereby pulling the zipper segment out of the zipper placement head.

21. An apparatus as set forth in claim 16 wherein the folding and sealing means includes a vertical form, fill and seal machine.

* * * * *